United States Patent [19]

Rice et al.

[11] 4,033,242

[45] July 5, 1977

[54] CARTON FORMING MACHINE

[75] Inventors: William A. Rice, Vernon; Clifford B. Rice, Warehouse Point, both of Conn.

[73] Assignee: Rice Packaging, Inc., Ellington, Conn.

[22] Filed: Sept. 26, 1975

[21] Appl. No.: 617,016

[52] U.S. Cl. ..... 93/51 R; 93/47

[51] Int. Cl.[2] ..... B31B 3/26

[58] Field of Search ..... 93/51 R, 47, 51 M, 41, 93/49 R, 36 R

[56] References Cited

UNITED STATES PATENTS

| | | | |
|---|---|---|---|
| 2,583,641 | 1/1952 | Gaubert et al. | 93/51 R |
| 2,794,373 | 6/1957 | Lindsay et al. | 93/51 R |
| 3,218,940 | 11/1965 | Pearson | 93/51 R |
| 3,513,757 | 5/1970 | DiFrank | 93/51 R X |
| 3,763,749 | 10/1973 | Sawada | 93/51 R |

*Primary Examiner*—James F. Coan

*Attorney, Agent, or Firm*—Ross, Ross & Flavin

[57] ABSTRACT

A machine for forming cartons from pre-cut and prescored blanks comprising a carton blank storage and first feed subassembly for feeding blanks linearly from a stack thereof and which is adjustable to accommodate blanks of different lengths, widths and thicknesses; a second feed sub-assembly for accepting the blanks and including a pair of endless travelling belts for feeding the carton blanks linearly; a flap bending and glue or hot melt applicator subassembly for bending certain of the flaps upwardly and holding certain others of the flaps downwardly for applying glue or hot melt to said certain others of the flaps of certain blanks fed thereto, this subassembly being adjustable to accommodate blanks of different widths and lengths; and a forming subassembly including front and rear formers and side formers which together form a well which is adjustable to accommodate blanks of different widths and lengths, and a forming block which is movable and adjustable with the front and rear and side formers for accommodating blanks of different widths and lengths and which is movable into the well for erecting the blanks into cartons.

4 Claims, 12 Drawing Figures

CARTON FORMING MACHINE

It is a primary object of this invention to provide a machine for erecting cartons from pre-cut and pre-scored blanks, the machine having universal adjustability for accepting a wide range of blank sizes and thicknesses.

Another object is to provide a machine which can be changed over between different carton blank sizes and styles in a matter of minutes as opposed to the hours required with most prior art machines.

Figure 1:
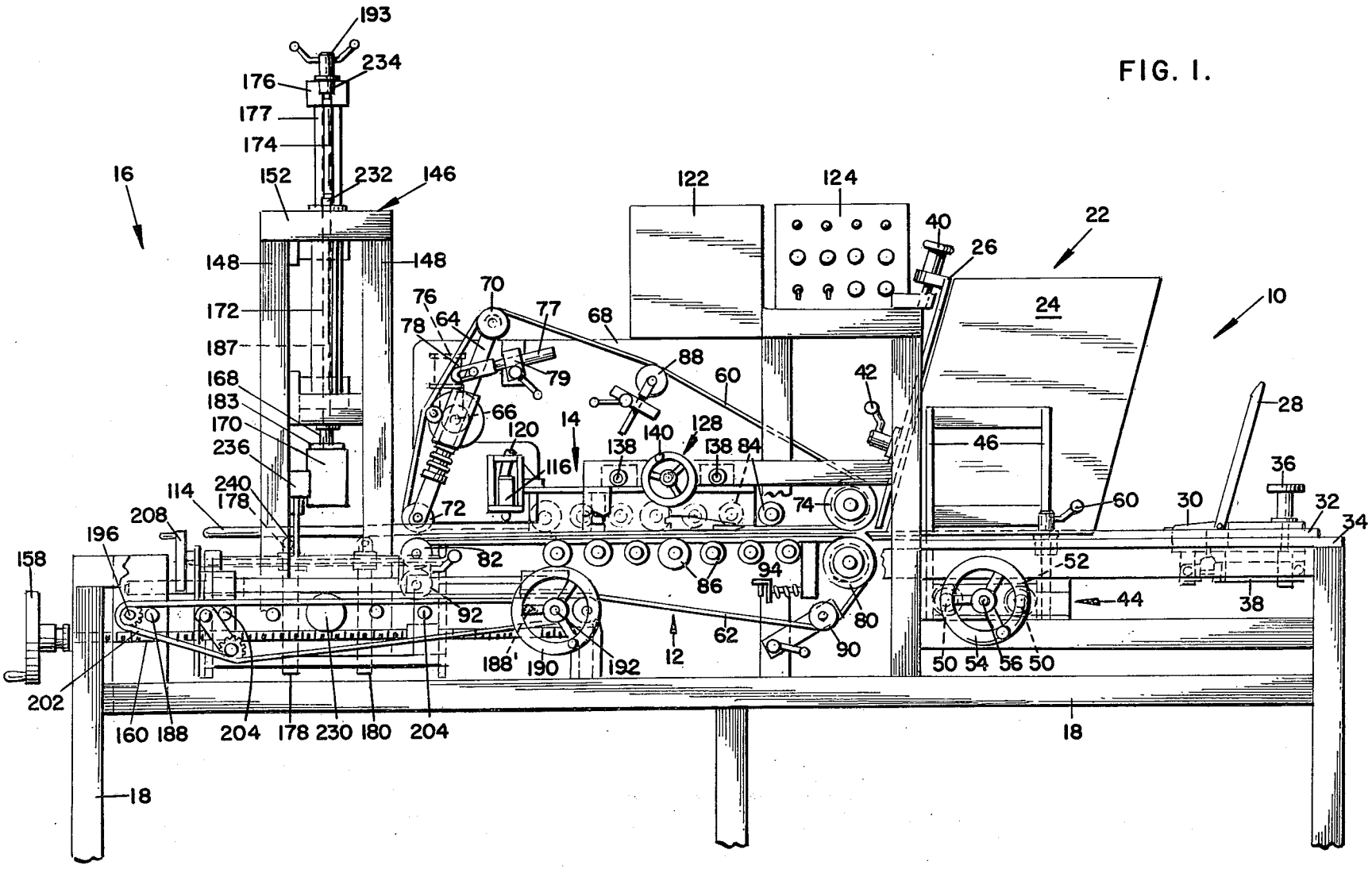
FIG. 1 is a front elevational view of a carton erecting machine embodying a preferred form of the invention.

The machine of the invention includes a carton blank storage and first feed subassembly 10, a second feed subassembly 12, a flap bending and glue or hot melt applicator subassembly 14, and a forming subassembly 16, each operatively connected with the other and all supported upwardly of the floor or the like by a supporting framework 18.

The machine is adapted to form cartons from pre-cut and pre-scored blanks 20 which are fed in seriatim from a stack thereof. While a particular style of blank has been shown in FIG. 8, same is for illustrative purposes only, it being understood that the machine is extremely versatile and is capable of accommodating a wide range of carton blank sizes and shapes.

THE CARTON BLANK STORAGE AND FIRST FEED SUBASSEMBLY

Figure 4:
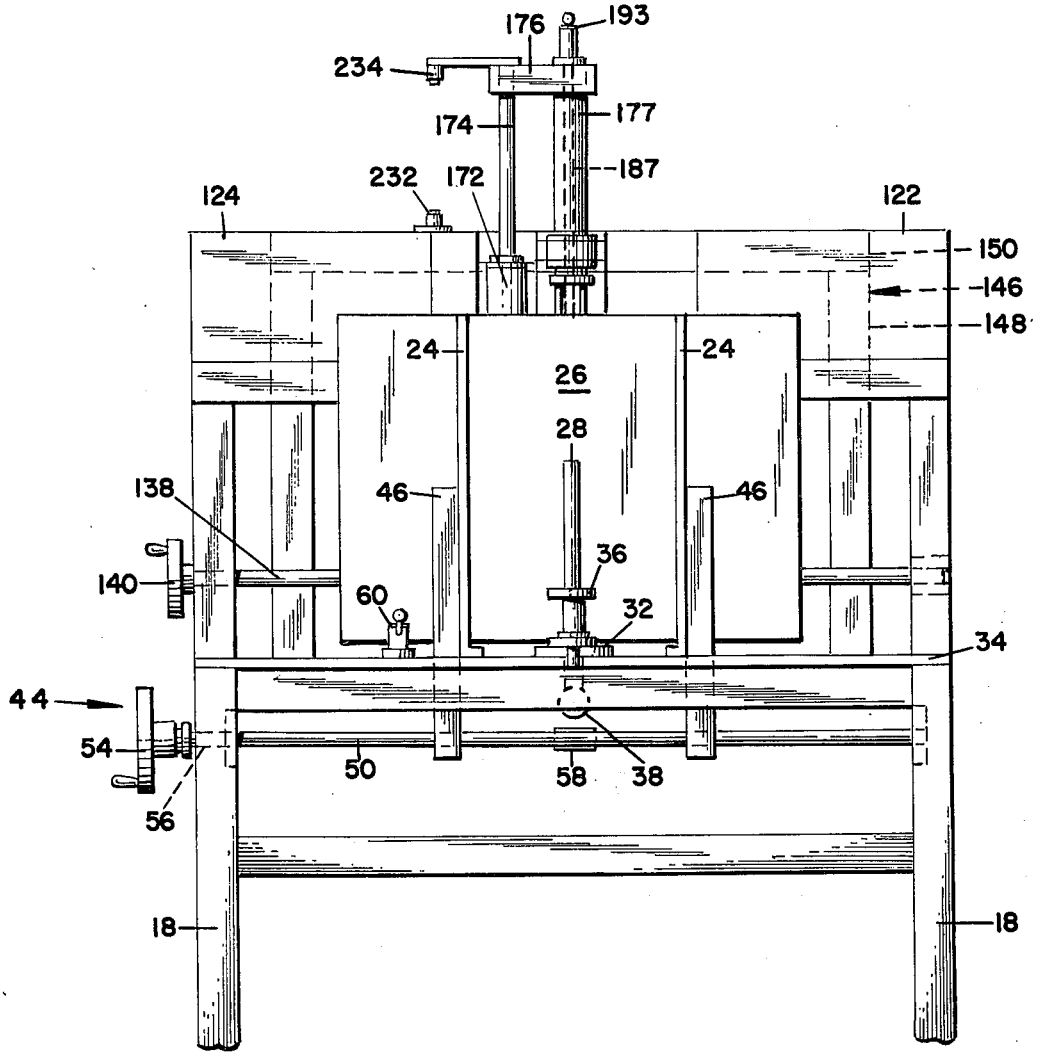
FIG. 4 is an end elevational view as seen from the right of FIG. 1.

As best seen in FIGS. 1 and 4, the carton blank storage and first feed subassembly 10 includes a hopper 22 having spaced parallel and upright side walls 24, an inclined upright front wall or slicing plate 26, and an inclined, upright stacking bar 28 which is pivoted at its lower end to a first feed member 30 mounted for slidable longitudinal movement relative to a grooved slide plate 32 provided on the longitudinal central axis of an upper wall 34 of supporting framework 18.

The lower end of hopper front wall 26 is spaced upwardly from upper wall 34 of supporting framework 18, thereby providing a space for the passage of a carton blank outwardly from the hopper.

Reciprocating movement of first feed member 30 is effected by a feed cylinder 38 linked thereto and mounted relative to supporting framework 18 below upper wall 34.

Forward movement of first feed member 30 (i.e., to the left as viewed in FIG. 1), will eject the lowermost carton blank from a stack thereof in hopper 22 outwardly from the hopper under the lower end of hopper front wall 26 in the space provided between the hopper front wall and upper wall 34.

Feed cylinder 38 may be locked in position relative to slide plate 32 by a locking handle 36, with the cylinder being repositionable so that the stacking bar and first feed member can accommodate carton blanks of different lengths.

An adjustment member 40 is provided for adjusting the vertical positions of hopper front wall 26 relative to the hopper, whereby the size of the space between the lower end of the hopper front wall and the upper wall 34 may be varied to accept different thicknesses of carton blanks.

A locking member 42 is provided for locking hopper front wall 26 in desired positions.

Figure 5:
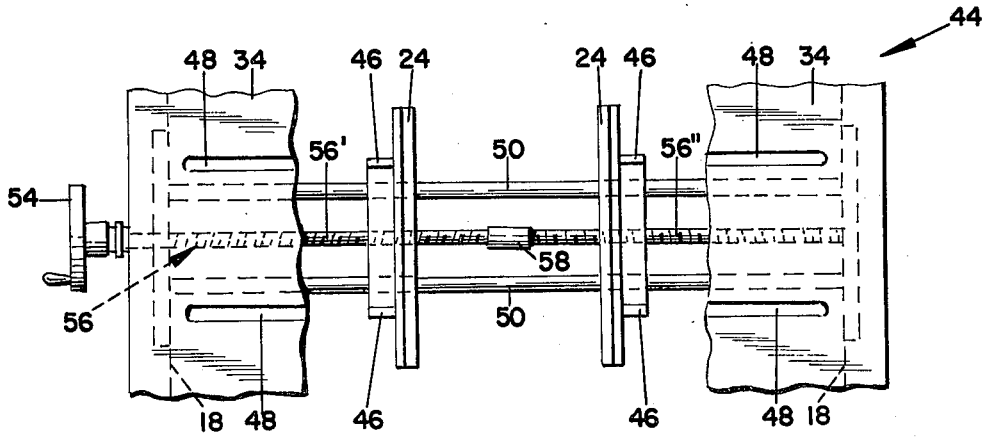
FIG. 5 is a top plan view of the means for effecting movement of the hopper side walls, with certain parts broken away and other parts omitted for clarity.

As best seen in FIGS. 4 and 5, hopper adjustment means 44 is provided for effecting transverse movement of hopper side walls 24 toward and away from each other for varying the space therebetween for accepting carton blanks of different widths.

Hopper adjustment means 44 includes a pair of spaced bracket members 46 fixed to the hopper side walls and which extend downwardly through spaced, transversely extending slots 48 in upper wall 34.

A pair of spaced, parallel slide rods 50 extend transversely between the sides of framework 18 and through provided openings in a connecting bar 52 which extends between the lower ends of bracket members 46, with each connecting bar being slidable along and relative to the slide rods.

An actuating handle 54 is fixed to the outer free end of a screw 56 which also extends transversely between the sides of framework 18.

Screw 56, which is positioned between and parallel to slide rods 50, extends through threaded openings in each connecting bar 52, and has axially aligned left and right hand threaded portions 56' and 56'' respectively connected by a connector 58, whereby rotation of handle 54 will effect opposite transverse movement of the brackets 46 and the hopper side walls 24 fixed thereto.

A locking member 60 is provided for locking for hopper side walls in desired positions of adjustment.

From the foregoing it will be seen that the hopper may be quickly and easily adjusted to accept carton blanks of a variety of lengths, widths and thicknesses, and with a single adjustment handle effecting opposite movement of the hopper side walls.

THE SECOND FEED SUBASSEMBLY

Carton blank 20 is ejected from hopper 22 to second feed subassembly 12, best seen in FIG. 1, which includes a pair of upper and lower travelling belts 60 and 62 respectively, each of which is entrained about a plurality of rolls journalled relative to supporting framework 18, with the carton blank being fed from the hopper into the nip between the upper and lower belts.

A substantially vertically disposed upper belt swing arm 64 is pivoted at 66, centrally of its length, to an upright plate 68 which is provided on the longitudinal central axis of upper wall 34 of supporting framework 18.

Upper belt swing arm 64 is provided at its upper end with an upper roller 70 and at its lower end with a lower roller 72, the upper belt 60 being entrained around the rollers 70 and 72 and around an upper belt rear roller 74 journalled relative to plate 68 immediately forwardly of hopper 22.

A swing arm cylinder 76 is coupled to swing arm 64 adjacent the pivot 66, whereby actuation of the cylinder will effect swinging movement of the swing arm relative to pivot 66, causing the lower end of the swing arm to move rearwardly, thereby decreasing the pressure exerted at the nip between the upper and lower belts, all for purposes to appear.

Adjustment of the range of swinging movement of swing arm 64 may be effected by movement of an arm 77 relative to a bracket 79 on plate 68, the arm 77 having a connector 78 slidably linked to the swing arm.

Lower belt 62 is entrained about a lower belt rear roller 80 vertically aligned with upper belt rear roller 74 and about a lower belt forward roller 82 vertically aligned with lower roller 72 of upper belt swing arm 64.

A plurality of upper belt pressure rollers 84 journalled relative to plate 68 exert pressure on the lower reach of upper belt 60 while a plurality of lower belt pressure rollers 86 also journalled relative to plate 68, exert pressure on the upper reach of lower belt 62 for ensuring a firm pressure on the carton blank being fed by the belts.

An upper belt tension adjustment roller 88 is provided for adjusting the tension of the upper belt, and a lower belt tension adjustment roller 90 is provided for adjusting the tension of the lower belt.

Lower belt 62 is additionally entrained around a support roller 92 vertically aligned with and disposed in running relation with lower belt forward roller 82, the support roller providing additional support at the nip between the rollers 82 and 72.

THE FLAP BENDING AND GLUE OR HOT MELT APPLICATOR SUBASSEMBLY

This subassembly, generally indicated by 14, is disposed upwardly of the path of travel of the carbon blanks 20 adjacent the lower reach of upper belt 60 and includes a pair of spaced, parallel, upright and longitudinally extending creasing plates 94 which are disposed one on each side of plates 68, the lower edges of the creasing plates being disposed immediately above score lines 96 of the carton blank for facilitating bending of flaps 98 and 100 at the score lines, as will appear.

Figure 6:
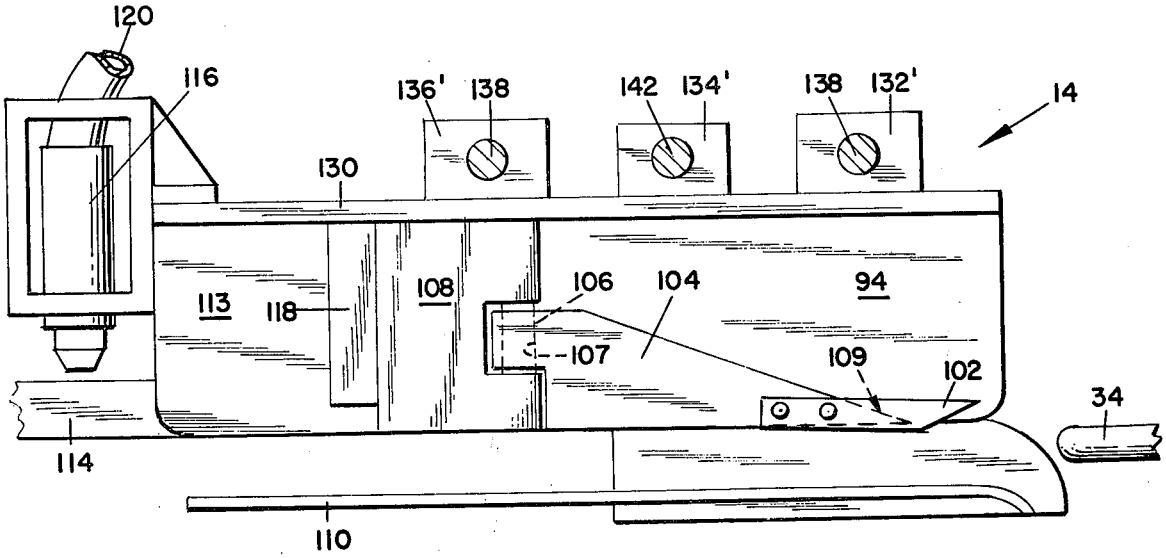
FIG. 6 is an enlarged, fragmentary front elevational view of the flap-bending and glue or hot melt applicator subassembly.
Figure 7:
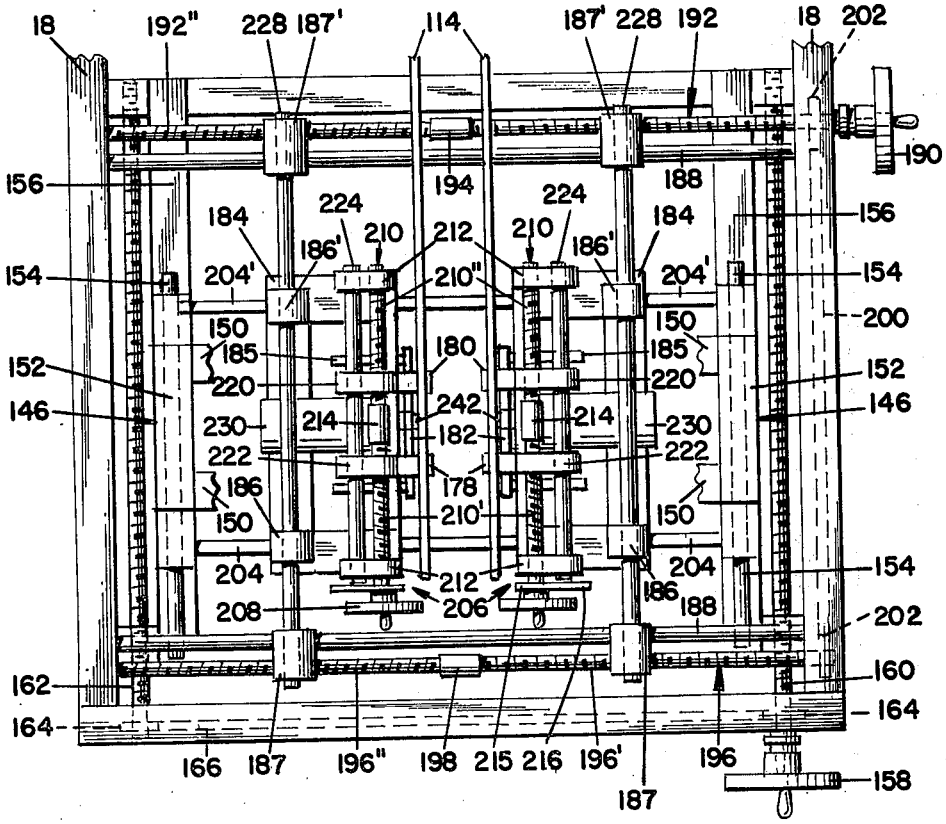
FIG. 7 is a top plan view of the means for effecting movement of the forming subassembly, with certain parts broken away and other parts omitted for clarity.
Figure 11:
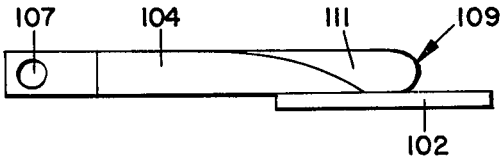
FIG. 11 is a top plan view of the plow means.

As best seen in FIGS. 6 and 11, a horizontally disposed, longitudinally extending plow 102 is fixed to a plow holder 104 pivoted, as by a vertically extending pin 106 which passes through an opening 107 in the plow holder, to a bracket 108 fixed to the outwardly facing face of each creasing plate, the plows extending rearwardly toward the feed hopper.

The plows 102 engage the flaps 98 and 100 of the carton blank passing therebelow and bend the flaps upwardly against the creasing plates at the score lines 96.

The plows can be set to accommodate blanks of different sizes by swining the plow holders 104 outwardly from the creasing plates 94 relative to pivot pins 106.

The rearwardly facing edge 109 of each plow holder 104 is suitably curved or chamferred as at 111 to provide a cam surface adapted to engage the flaps 112 of the carton blank for holding flaps 112 downwardly, this being necessary since flaps 112 will have glue or hot melt applied thereto.

Thus, as a carton blank is fed downwardly past the plow, flaps 98 and 100 are bent upwardly by plow 102 while flaps 112 are held downwardly by the rearwardly facing face of the plow holder.

The upwardly bent flaps 98 and 100 pass rearwardly of the plow holder 104 and bracket 108 and through an upright, vertically slotted retainer 113 provided forwardly of bracket 108.

Additional flap guides or retainers 114 extend horizontally and longitudinally forwardly from each slotted retainer 113 for retaining flaps 98 and 100 in their upwardly bent condition.

A horizontally disposed, longitudinally extending support plate 110 is disposed below each creasing plate 94 for supporting the flaps 112 to prevent them from dropping as they are fed forwardly.

A glue or hot melt dispenser nozzle 116 is provided at the forward end of each creasing plate, actuation of the nozzles being controlled by a photo-electric cell 118 provided on one of the creasing plates immediately rearwardly of the nozzles, the beam of the photo-electric cell being broken by the carton blank passing therebelow.

Glue or hot melt is delivered to the nozzles by supply lines 120 connected to a supply container 122, (see FIG. 1). The particular pattern with which the glue or hot melt is applied to the flaps 112 is controlled by a pattern selector 124.

Figure 8:
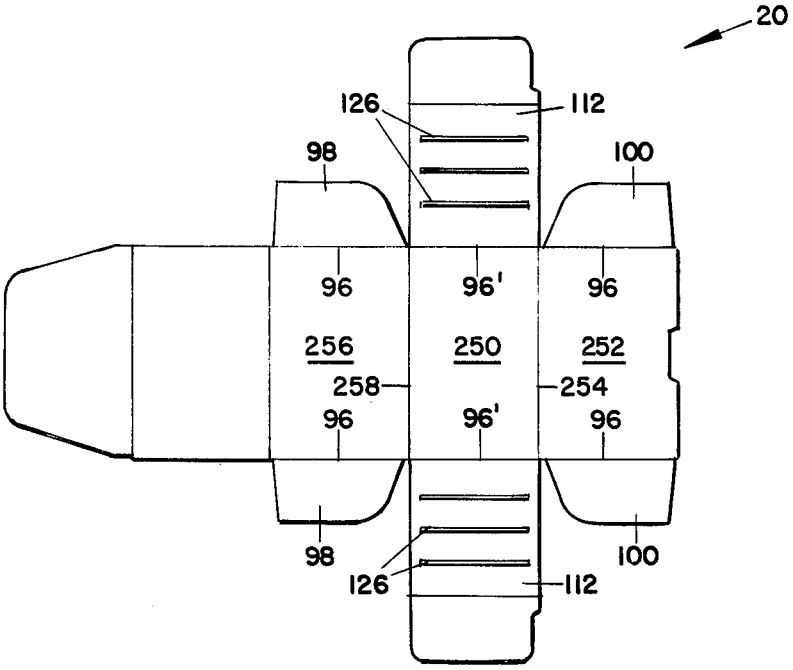
FIG. 8 is a top plan view of one of a variety of types of carton blanks which may be erected using the machine of the invention.

One possible pattern of glue or hot melt application to flaps 112 is indicated at 126 in FIG. 8. A continuous or skip pattern can be employed as desired.

In addition, the size of the pattern can be varied by raising or lowering the nozzles or by moving them in or out.

Figure 3:
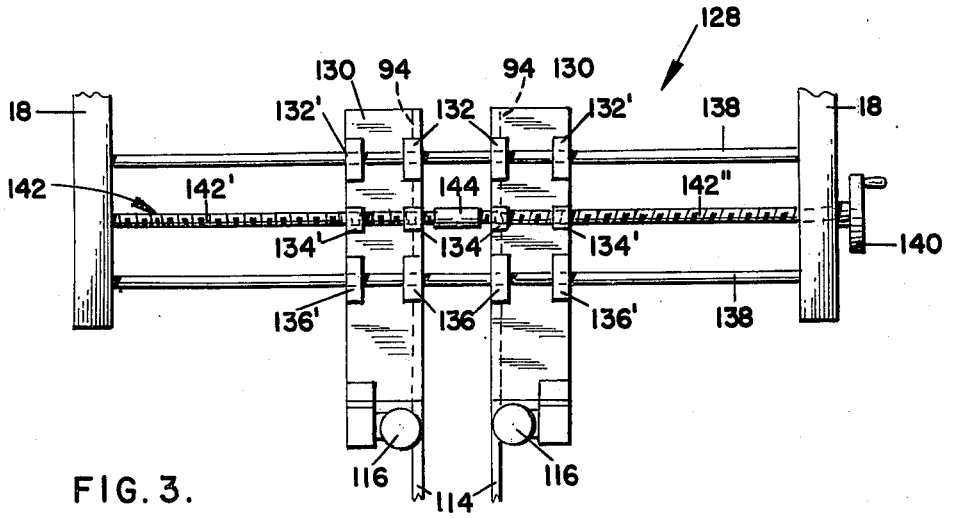
FIG. 3 is a top plan view of the means for effecting movement of the flap bending sub-assembly, with parts omitted for clarity.

As best seen in FIG. 3, adjustment means 128 is provided for effecting transverse movement of creasing plates 94 toward and away from each other for varying the space therebetween for accepting carton blanks of different widths.

Adjustment means 128 includes an upper horizontally disposed wall 130 on the upper edge of each creasing plate, the walls each having a first trio of spaced bosses 132, 134 and 136 extending upwardly therefrom adjacent their inner edges, and a second trio of spaced bosses 132′, 134′ and 136′ extending upwardly therefrom adjacent their outer edges and axially aligned with the bosses 132, 134 and 136.

A pair of spaced, parallel slide rods 138 extend transversely between the sides of framework 18 and through provided openings in bosses 132, 132′, 136 and 136′, with the bosses, and hence the creasing plates, being slidable along and relative to the slide rods.

An actuating handle 140 is fixed to the outer free end of a screw 142 which also extends transversely between the sides of framework 18.

Screw 142, which is positioned between and parallel to slide rods 138, extends through threaded openings in each boss 134 and 134′, and has axially aligned left and right hand threaded portions 142' and 142'' respectively connected by a connector 144, whereby rotation of handle 140 will effect opposite transverse movement of the creasing plates toward and away from each other.

THE FORMING SUBASSEMBLY

Forming subassembly 16 is disposed immediately forwardly of belts 60 and 62 and subassembly 14 and includes a subframework 146 which is longitudinally movable relative to supporting framework 18, the subframework comprising pairs of spaced, parallel and upright side frame members 148 disposed inwardly of the adjacent side frame members of supporting framework 18, and interconnected at their upper ends by transversely extending crossframe members 150 and longitudinally extending crossframe members 152.

The lower end of each side frame member 148 is slidably mounted on a longitudinally extending slide rod 154 provided on a base member 156 of framework 18.

Longitudinal movement of the sub-framework 146 is effected by rotation of an actuating handle 158 fixed to the outer free end of a longitudinally extending screw 160 which is threaded in framework 18 and in one side of sub-framework 146, a similar longitudinally extending screw 162 being threaded in the opposite side of sub-framework 146, in spaced parallelism to screw 160, each screw having a sprocket 164 fixed thereto adjacent its outer end with an endless chain 166 entrained around the sprockets whereby rotation of handle 158 effects rotation not only of screw 160, but also of screw 162 for setting up longitudinal movement of the sub-framework.

Sub-framework 146 supports a vertically extending ram 168 which carries a forming block 170 at its lower free end, the forming block being of appropriate size to erect the carton 20 being fed to the forming area from the belts 60 and 62, as will appear.

A vertically extending cylinder 172 has a rod 174 linked to ram 168 by a bracket 176 whereby reciprocation of the piston rod effects concomitant reciprocation of the ram and forming block, the ram being sleeved within a guide 177 mounted for slidable movement relative to subframework 146.

Figure 9:
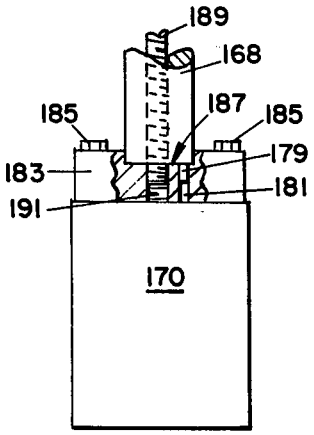
FIG. 9 is a fragmentary elevational view of the forming block.

As best seen in FIG. 9, the forming block is secured to the ram by a novel arrangement which includes a pin 179 on the lower end of the ram receivable in a slot 181 in a plate 183 fixed to the upper end of the block as by volts 185, the lower end of the ram also being receivable in a central opening 187 in plate 183.

In addition, a rod 189 extends downwardly through the ram and is threaded in a threaded opening 191 in plate 183.

Rotation of rod 189 is effected by a handle 193 (see FIG. 1), at the upper end thereof.

By this novel arrangement, blocks of different sizes to accommodate carton blanks of different sizes may be quickly and easily attached to the ram and are perfectly positioned for carton erection.

Sub-framework 146 carries pairs of spaced, parallel and upright front and rear formers 178 and 180 respectively and a pair of spaced, parallel, upright and longitudinally extending side forming pressure plates 182, all positioned immediately below forming block 170 and defining a well in which the forming block is receivable.

The front and rear formers and side forming pressure plates are supported relative to sub-framework 146 by support members 184 which are mounted for transverse movement toward and away from each other, the support members 184 each having upright front and rear blocks 186 and 186' respectively adjacent their outer ends which are slidably mounted on a first pair of spaced, parallel forward and rearward slide rods 204 and 204' respectively which extend transversely between the sides of framework 18.

The support members 184 are also adapted for longitudinal movement, coincident with such movement of sub-framework 146, being slidably mounted on a pair of spaced, parallel, longitudinally-extending slide rods 228 which extend through front and rear blocks 186 and 186' of the support members and through a second pair of front and rear support blocks 187 and 187' which extend upwardly from supporting framework 18.

The means for effecting transverse movement of the support members 184 toward and away from each other includes an actuating handle 190 fixed to the outer free end of a first screw 192 which extends transversely between the sides of framework 18, and is threaded in rearward support blocks 187', and a similar second screw 196, disposed in spaced parallelism to first screw 192, which extends transversely between the sides of framework 18 and is threaded in forward support blocks 187.

First screw 192 has axially-aligned left and right hand threaded portions 192' and 192'' respectively connected by a connector 194, while second screw 196 has axially-aligned left and right hand threaded portions 196' and 196'' respectively connected by a connector 198.

Screws 192 and 196 are interconnected by a chain 200 which is entrained about sprockets 202 fixed to each screw, whereby rotation of handle 190 effects rotation not only of screw 192, but also of screw 196 for setting up transverse movement of support members 184 toward and away from each other.

A second pair of transversely extending slide rods 188 is provided, one such slide rod being positioned adjacent each of the screws 192 and 196, and extending transversely the sides of framework 18 and through the adjacent forward or rearward support blocks 187 and 187' respectively.

The pairs of front and rear formers 178 and 180 and side forming pressure plates are carried by support members 184 and are movable concomitantly with the support members transversely toward and away from each other and longitudinally coincident with movement of sub-framework 146.

The front and rear formers of each pair are also movable longitudinally toward and away from each other, there being separate but identical actuating means 206 for effecting such movement. These means being identical, only one will be described.

Actuating means 206 includes an actuating handle 208 fixed to the outer free end of a screw 210 which extends longitudinally between and is threaded in upright portions 212 on support members 184, the screw having axially aligned left and right hand threaded portions 210' and 210'' respectively connected by a connector 214.

Figure 2:
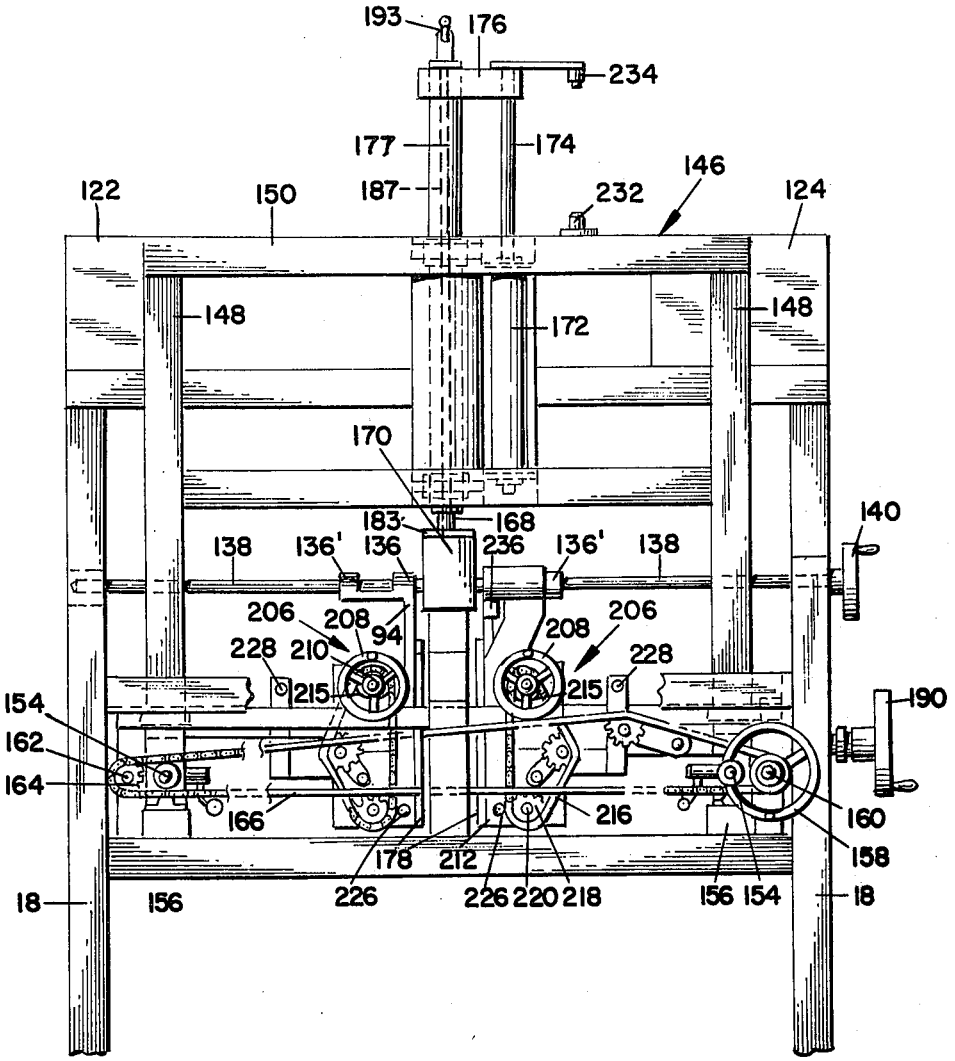
FIG. 2 is an end elevational view as seen from the left of FIG. 1.

Screw 210 has a sprocket 215 fixed adjacent its outer end, the sprocket having a chain 216 entrained therearound and around a sprocket 218, (see FIG. 2), spaced therebelow and fixed to the outer end of a lower longitudinally extending screw 220 identical to screw 210 and threaded in upright portions 212 of support members 184.

The screws are additionally threaded in intermediate upright members 222 which carry the front and rear formers, with the upright members 222 being slidable longitudinally relative to spaced, parallel, longitudinally extending upper and lower slide rods 224 and 226 respectively which extend between the upright portions 212 of support members 184, whereby rotation of handles 208 effect longitudinal movement of the front and rear formers 178 and 180 toward and away from each other.

Side forming pressure plates 182 are mounted for transverse sliding movement relative to support members 184, the side forming pressure plates each having a pair of spaced, parallel slide rods 185 disposed normal to the pressure plates and extending outwardly from the pressure plates through the support members.

Figure 10:
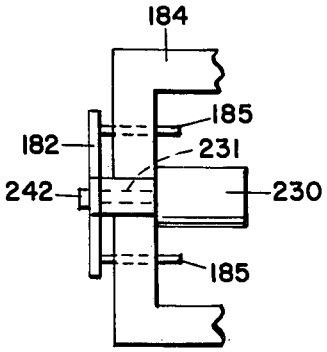
FIG. 10 is a fragmentary top plan view of one of the side pressure plates and its supporting and motivating means.

As best seen in FIG. 10, the means for effecting transverse movement of the side forming pressure plates 182 comprises an air cylinder 230 fixed to each support member 184 and having a piston rod 231 fixed to the side forming pressure plate.

Air cylinders 230 urge the side forming pressure plates inwardly against a carton blank being formed in the well between the forming block and the side forming pressure plates, with actuation of the cylinders being effected upon actuation of a switch 232 of subframework 146 by a switch actuator 234 which extends outwardly from the upper end of piston 174 and with switch actuation occurring on the downward stroke of ram 168.

A second photo-electric cell 236 located adjacent the forming block signals the ram to start downwardly when the leading edges of the flaps 112 contact stops 238 disposed adjacent the well and front formers 178.

Front formers 178 are pivoted at their upper ends as at 240 to intermediate upright members 222 and the lower ends of the front formers are free for swinging movement toward and away from the rear formers 180 which are fixed at their upper and lower ends.

Figure 12:
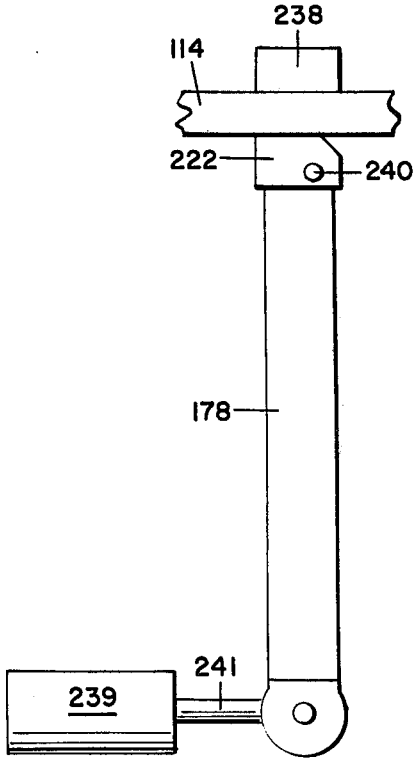
FIG. 12 is an elevational view of one of the front formers.

Swinging movement of the lower ends of the front formers is effected by air cylinders 239, (see FIG. 12), each air cylinder 239 having a piston rod 241 fixed to the lower end of one of the front formers.

It is desirable to provide for swinging movement of the lower ends of the front formers so that they can be swung out of the way to permit an erected carton to clear the well after it has been formed.

A spring-loaded stripper 242 is built into the inwardly-facing face of each side forming pressure plate 182 to strip the erected carton off of the forming block.

THE SEQUENCE OF MACHINE OPERATION

A pre-cut blank 20 is fed from hopper 22 to belts 60 and 62 and then through the flap-bending mechanism 14, where flaps 98 are bent up by the plows 102, with the creasing plate 94 serving as the bending edge, and with flaps 112 being held down by the cam surfaces 111 so they are not picked up by the plows, and with the flaps 100 being bent up by the plows along the score lines 96.

The blank continues through the flap guide system with flaps 98 and 100 being held up for forming and also so that glue is not applied thereto.

The flaps 112 pass through the beam of photo-electric cell 118 which, through pattern selector 124, fires solenoid guns or nozzles 116 which dispense hot melt onto flaps 112 at a given time and length as derived through the pattern selector, which glue pattern can be of continuous or skip type.

Flaps 98 and 100 are heldup by flap guides or retainers 114 as the carton is advanced.

The carton blank continues to move forward to the stops 238, the stops being contacted by the forward edges of flaps 112, directly under the forming well which has been preset in size to conform to the size of the blank.

As soon as flaps 112 contact stops 238, second photocell 236 is made to start forming ram 168 down.

As soon as the second photocell 236 is made, upper belt swing arm 64 retracts, (swings rearwardly) via rotary actuating cylinder 76 to clear the trailing edge of the carton for forming.

As soon as the second photocell 236 is made, first feed member 30 in the hopper 22 is sent forwardly to eject another blank between the belts 60 and 62, with the hopper front wall 26 being set to allow the feeding of only one blank at a time.

Simultaneously, the lower ends of the front formers 178 are swung inwardly by the cylinders 239 to form the well.

As the ram moves downwardly, it contacts a bottom panel 250 of carton blank 20 and moves the blank into the well.

The rear formers 180 erect a rear panel 252 which carries the flaps 100, the rear panel bending upwardly along a score line 254 which also defines a first side of bottom panel 250.

The front formers 178 erect a front panel 256 which carries the flaps 98, the front panel bending upwardly along a score line 258 which also defines a second side of bottom panel 250.

Simultaneously, side formers 182 bend the flaps 112 upwardly along the score lines 96', which also defined the ends of the bottom panel 250, the score lines 96' being aligned with and connecting between the score lines 96.

The flaps 112 are now disposed outwardly of and in contact with the flaps 98 and 100, it being recalled that the flaps 98 and 100 have already been bent normal to the planes of the panels 252 and 256 along the score lines 96.

When the forming ram 168 is fully down, micro-switch 232 is made and the cylinders 230 advance the pair of side forming pressure plates 182 transversely toward each other to fully compress the flaps 112 against the flaps 98 and 100, the latter bearing against the forming block 170, to set the hot melt 126.

When micro-switch 232 is made a timing cycle is started which retracts:

a. the forming pressure plates 182;
b. the front formers 178; and
c. the forming ram 168.

As forming ram 168 is retracting, forming block 170 passes by the set of spring-loaded strippers 242 on the side forming pressure plates 182 to strip the erected carton off of the forming block.

MACHINE SET UP AND ADJUSTMENT

I. THE HOPPER

1. Set and lock hopper front wall 26 to set the slice feed gap size for the caliper or thickness of the blank.
2. Set and lock the hopper side plates 24 by the single adjusting handle 54 for the width of the blank.

3. Set and lock the first feed member 30 for the length of the blank.

II. THE BELTS

The belt assembly is spring-loaded to accommodate blanks of different thicknesses.

III. THE FLAP BENDERS

1. Set flap bender creasing plates 94 by the handle 40 to the width of the blank at the score lines 96 for flaps 98 and 100 to bend against as the blank advances past the plows 102.
2. Manually adjust the plow holders 104 for the width of the flaps 98 and 100, the plows being pivotal in and out for accommodating different blank sizes.

IV. THE WELL

1. Install the proper size forming block 170.
2. Send the forming ram 168 down and advance the front formers 178.
3. Adjust and lock the right side front and rear formers 178 and 180 respectively and integral stop 238 and second photocell 236 by one of the handles 208.
4. Adjust and lock the left side front and rear formers 178 and 180 respectively and stop 238 by the other handle 208.
5. Adjust and lock the side pressure forming plates 182 simultaneously by the handle 190.
6. Send the ram 168 up and the side pressure forming plates 182 back.
7. Move the entire sub-framework 146 and its component parts so that the rear of the forming well clears the front end of the lower belt 62 and set and lock the sub-framework.

V. THE UPPER BELT SWING ARM

Set and lock the upper belt swing arm 64 by jogging a blank up against the stops 238, and setting the swing arm so that it drives the blank only up to the stops.

VI. THE PATTERN SELECTOR

Set the pattern selector 124 to predetermined settings to conform to the blank being processed.

Set the dispenser nozzles, moving them in or out or up or down, and make the final fine tuning setting of the dispenser nozzles by setting the pattern selector.

MACHINE ADVANTAGES

The vertical center line of ram 168 is always on the vertical center line of side pressure plates 182 and the horizontal center line of the forming block 170 is always on the horizontal center line of the side pressure plates.

In the prior art machines, the rear edge of the forming well is fixed—wherefore only the front edge can be adjusted. Thus, the side formers cannot be aligned with the center of the forming block.

The center lines of the side plates and ram are not the same with prior art machines. In addition, the height of the block cannot be changed, wherefore the plates tip at their tops and bottoms.

The majority of prior art machines take anywhere from 1 to 4 hours to set up. The machine of the invention takes only about 10 minutes of changeover time for adjustment between different styles and sizes of carton blanks, the machine of the invention having universal adjustability.

There also is a considerable difference in the cost per box for initial tooling. Prior art machines run, anywhere from $150.00 to $3,000.00 per item, while applicants' averages about $50.00 per item.

We claim:

1. A machine for forming cartons from a stack of pre-cut and pre-scored blanks comprising: conveyor means for moving the blanks linearly in seriatim away from the stack, front and rear and side formers adjacent the end of the conveyor means and defining a well, a forming block and means for moving the forming block into and out of the well for forming the carton, first positioning means for positioning the well and forming block relative to the conveyor means, second positioning means for moving the side formers relative to each other, third positioning means for moving the front and rear formers relative to each other, and a flap bending and hot melt applicator subassembly adjacent the conveyor means including means for deflecting certain of the flaps of the blank being fed by the conveyor means, means for retaining certain other of the flaps of said blank against deflection, and means for applying hot melt to said certain other of the flaps of said blank which have been retained against deflection.

2. A machine for forming cartons according to claim 1, with the flap bending and hot melt applicator subassembly including a pair of creasing plates and fourth positioning means for moving the creasing plates relative to each other.

3. A machine for forming cartons according to claim 1, including a carton blank storage and first feed subassembly adjacent the conveyor means for storing and feeding blanks in seriatim from the stack to the conveyor means and including a blank storing hopper having spaced side walls, a slidable feed means for ejecting blanks from the hopper, fifth positioning means for moving the hopper side walls relative to each other, and sixth positioning means for moving the slidable feed means relative to the hopper.

4. A machine for forming carton blanks according to claim 1, with the conveyor means including a pair of endless belts and a swing arm, one of the endless belts being entrained around the swing arm, and means for effecting swinging movement of the swing arm and releasing of a carton blank at the nip between the belts.

* * * * *